US005440115A

United States Patent [19]

Bauco et al.

[11] Patent Number: 5,440,115

[45] Date of Patent: Aug. 8, 1995

[54] ZENER DIODE BIASED ELECTRON MULTIPLIER WITH STABLE GAIN CHARACTERISTIC

[75] Inventors: Anthony S. Bauco, Vernon, Conn.; Alan M. Then, Auburn, Mass.

[73] Assignee: Galileo Electro-Optics Corporation, Sturbridge, Mass.

[21] Appl. No.: 222,811

[22] Filed: Apr. 5, 1994

[51] Int. Cl.[6] ..... H01J 43/10

[52] U.S. Cl. ..... 250/207; 250/214 VT; 313/103 CM

[58] Field of Search ..... 250/227.11, 492.1, 214 VT, 250/207; 356/354; 313/103 CM, 105 CM

[56] References Cited

U.S. PATENT DOCUMENTS 3,868,536 2/1975 Enk, Jr. .
3,997,779 12/1976 Rabl ..... 250/207
4,948,965 8/1990 Feller .
5,367,222 11/1994 Binkley .
5,378,960 1/1995 Tasker et al. .

*Primary Examiner*—Edward P. Westin
*Assistant Examiner*—Jacqueline M. Steady
*Attorney, Agent, or Firm*—Watson, Cole, Grindle & Watson

[57] ABSTRACT

The invention employs a reverse biased zener diode in the output circuit of a single stage or multistage electron multiplier. In a multistage device, a bypass resistor is employed between stages for increasing the bias current in downstream stages which operates at reduced potential whereby power dissipation is minimized.

12 Claims, 4 Drawing Sheets

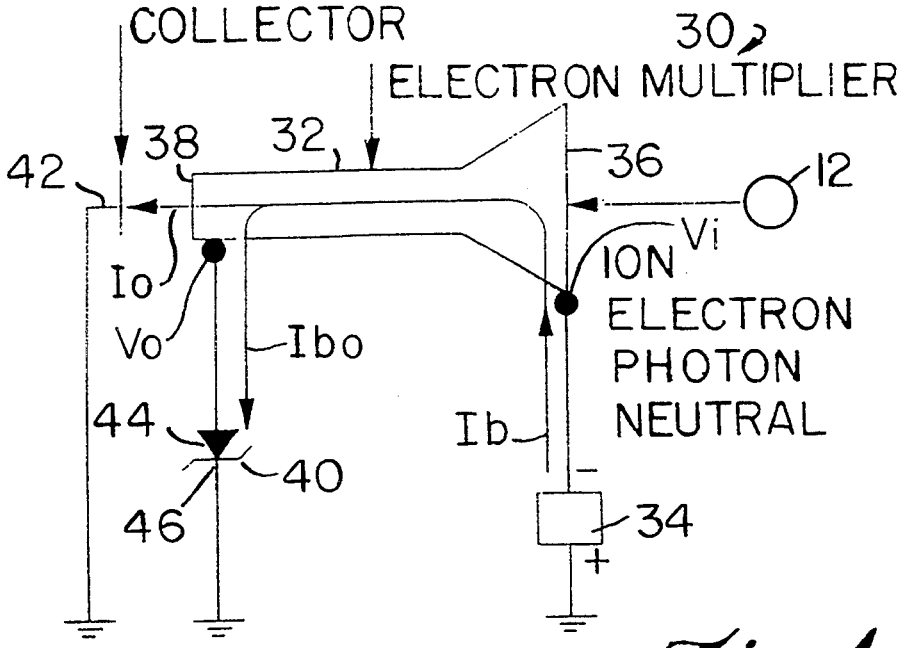
Fig. 4.
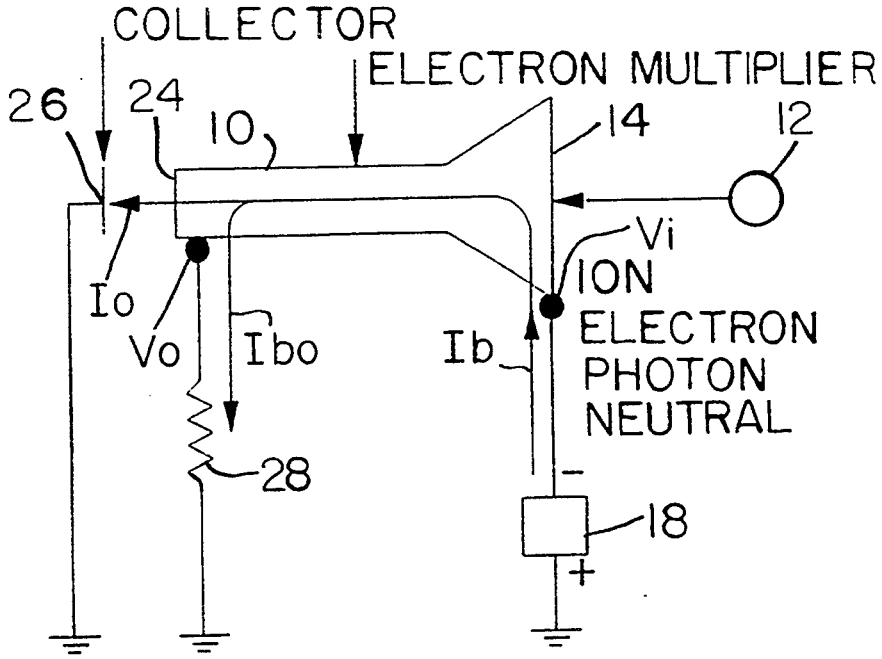
Fig. 3a.
Fig. 3.
(PRIOR ART)
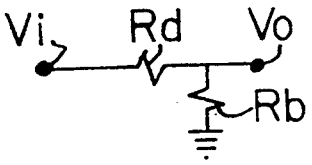

ZENER DIODE BIASED ELECTRON MULTIPLIER WITH STABLE GAIN CHARACTERISTIC

BACKGROUND OF THE INVENTION

The invention relates to electron multipliers. In particular, the invention relates to continuous dynode, channel electron multipliers employing a zener diode biasing arrangement.

Particle detectors employing channel electron multipliers (CEM) are well known. As used herein, the term CEM covers known single channel and multiple channel arrangement. A channel electron multiplier (CEM) is an example of a known single channel electron multiplier device. Such a device employs a continuous dynode which is an active surface formed on an interior wall of the channel. A continuous dynode is an active surface capable of supporting electron multiplication and carrying a bias current to replenish emitted electrons. Typically, the continuous dynode comprises a current carrying semiconductive layer which has been activated to support electron multiplication. The semiconductive layer is formed on a substrate such as the interior of a glass tube. A microchannel plate is an example of a multichannel arrangement of continuous dynodes.

An exemplary single channel CEM 10 is shown in FIG. 1. In such an arrangement, an energetic particle 12, such as an ion, an electron, a photon or a neutral particle enters the input end 14 of the device strikes the dynode surface 15, and typically produces two or three secondary electrons 16. These electrons are accelerated down the channel by a bias provided by high voltage source 18. The electrons 16 repeatedly strike the dynode 15 producing additional electrons (and so on) until a pulse of about $10^5$ -$10^8$ electrons 22 emerges at the output end. The pulse of output electrons 22 is detected by a collector 26. For positive ions, the input 14 is generally at a negative potential and the output 24 is at ground. Bias resistor 28 establishes a voltage relationship between the output 24 and the collector 26, which is at ground reference potential. In the exemplary electron multiplier 10, shown in FIG. 1, the dynode is an activated semiconducting layer formed on the interior of glass channel wall 20.

The gain of a channel electron multiplier is defined as a ratio of the output current to the input current. Gain in general is a function of the secondary emission coefficient of the dynode, the applied voltage, the ratio of the length of the channel to its diameter (1/d), and the ratio of the length to its radius of curvature (1/r) if the channel is curved.

FIG. 2 shows a typical gain versus voltage curve for a CEM 10. As the voltage applied to the CEM increases, the gain of the CEM increases. The desired operating point on the curve is determined primarily by whether the CEM is to be operated in the analog or pulse counting mode.

In the analog or current measurement mode, the linearity of the channel electron multiplier is dependent upon the conductivity or bias current capability of the device. Analog channel electron multipliers require an electrically isolated collector and an bias resistor, discussed below, which promotes linear output current generally between about 10 and 30 percent of the bias current.

For proper operation, the channel electron multiplier must be maintained at a positive bias. This means that the collector must be the most positive element in the detector circuit. As illustrated in FIG. 3, which is a schematic diagram of the arrangement of FIG. 1 with similar reference numerals, this may be accomplished by means of the bias resistor 28. The bias resistor 28 establishes a potential difference between the output 24 of the channel electron multiplier 10 and the collector 26, as illustrated. The bias resistor 28 may be a separate external device or it may be integrally formed on the external wall portion of the CEM 10. A disadvantage of integrated resistors is that they are difficult to control precisely. Also, the optimum resistance depends on the overall resistance of the CEM which can vary between devices and also changes with age. As the CEM ages, the gain decreases. Consequently, a higher potential is required across the device to boost the gain to the desired range. For example, in FIG. 3A, an electrical equivalent circuit of the device of FIG. 3. An electrical resistor $R_d$ represents the resistance of the CEM and an electrical resistor $R_b$ represents the bias resistance. By means of simple voltage division:

$$V_o = V_i R_b / R_b + R_d$$

Unfortunately, as the input voltage $V_i$ is increased in order to maintain the gain it is always divided. Therefore, it is necessary to increase the input voltage $V_i$ by a larger amount than if no voltage division were to occur. These larger increases in input voltage cause the device to reach its maximum operating voltage which is undesirable.

It has been suggested that it would be advantageous if a constant output potential could be maintained. It is possible, for example, to provide a constant voltage on the output of an electron multiplier by means of a separate power supply. However, the CEM is normally used in a vacuum environment. Thus, an additional feedthrough would be required plus the additional cost of the second power supply renders this expedient undesirable. It has also been suggested to employ a forward biased zener diode as a replacement for the bias resistor. However, such a forward biased zener diode would not operate properly to achieve the desired results.

SUMMARY OF THE INVENTION

The present invention is based upon the discovery that a reverse biased zener diode placed in the output circuit of a channel electron multiplier (CEM) maintains a constant potential between the CEM output and the collector. In addition, the zener diode bias circuit establishes a substantially constant gain characteristic in the linear region of the channel electron multiplier.

In a particular embodiment, the invention is directed to an electron multiplier having an input and an output adapted to be connected to a high voltage supply at a level to produce a desired gain. The invention comprises a saturable continuous dynode producing an output current which varies linearally in a region below saturation. A bias circuit is coupled between the input and the output for establishing a fixed output voltage and for establishing substantially constant gain characteristic in the linear region. The bias circuit includes at least one zener diode reverse biased relative to the supply. In the arrangement, the resistance of the zener diode varies with the output bias current Ibo flowing through the zener diode for maintaining a constant output voltage. In another embodiment, the electron multiplier is a multistage device and a zener diode is provided for each stage. In such an arrangement, a bypass resistor is coupled between the stages for increasing the bias current to each downstream stage in succession.

DESCRIPTION OF THE DRAWINGS

FIG. 3 is a schematic diagram of the channel electron multiplier illustrated in FIG. 1 showing electron current flows;

FIG. 3A is an equivalent circuit of the device in FIG. 1;

FIG. 4 is a schematic illustration of the channel electron multiplier according to the present invention with circuit elements and electron currents illustrated;

DESCRIPTION OF THE INVENTION

Figure 1:
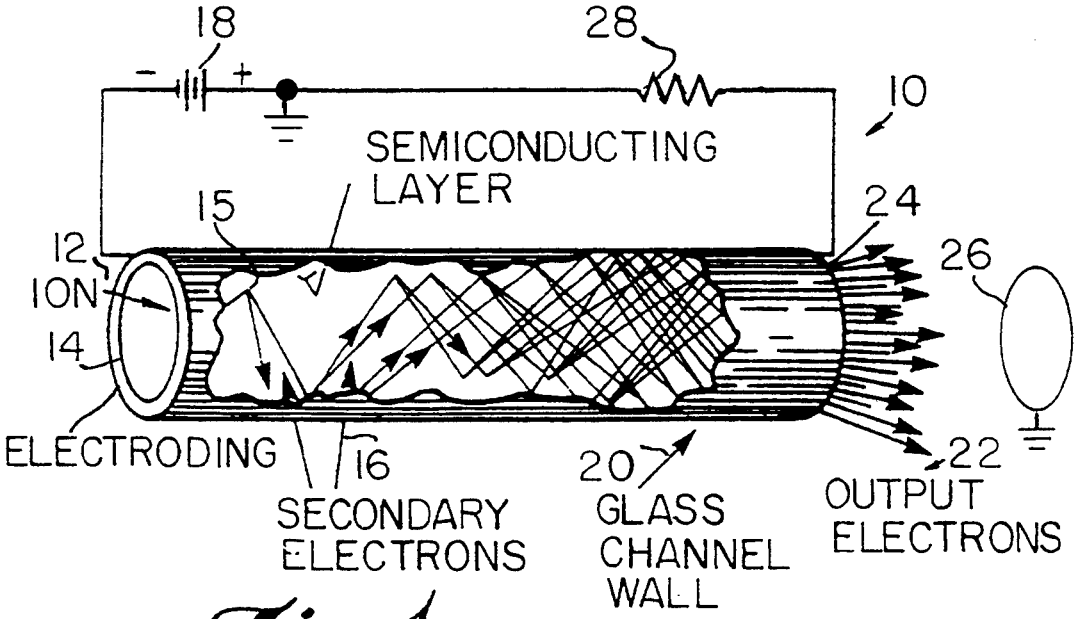
Fig. 1. (PRIOR ART)
FIG. 1 is a schematic illustration of a known channel electron multiplier.
Figure 2:
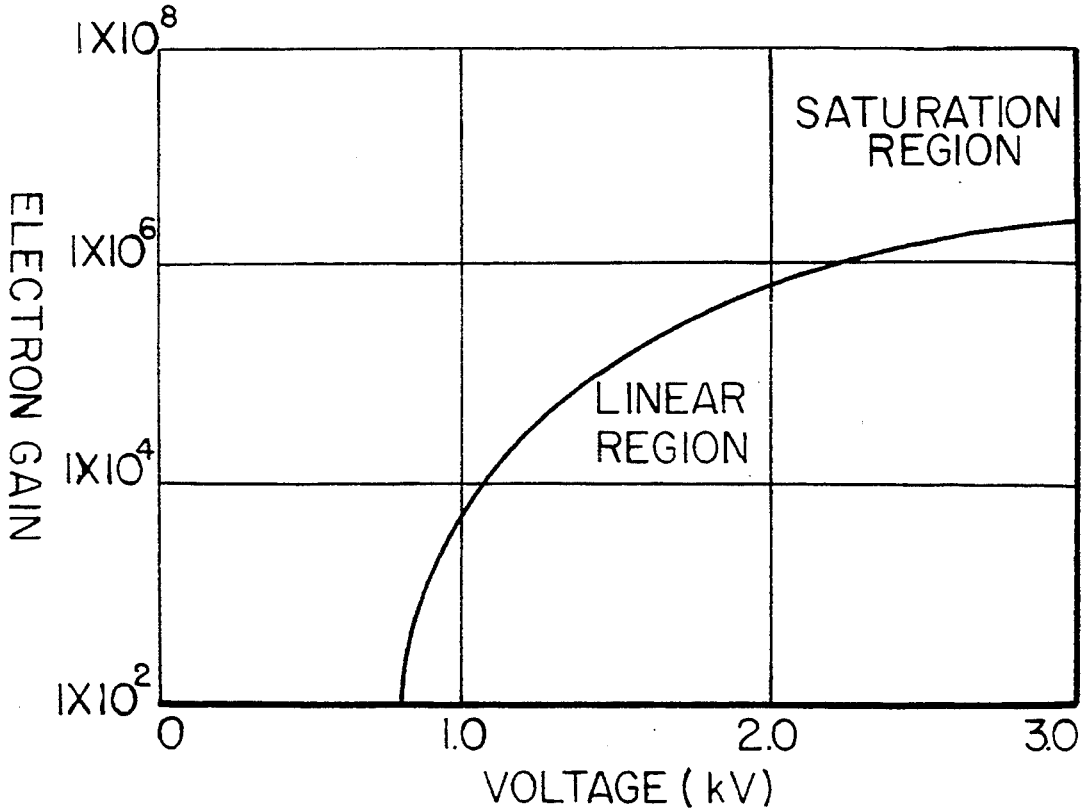
FIG. 2 is a graphic representation of the gain versus bias voltage characteristic of a channel electron multiplier.

FIG. 2 illustrates a detector 30 employing a single stage channel electron multiplier (CEM) 32 with a single power supply 34. The electron multiplier 32 has an input 36 and an output 38. The power supply 34 is a high voltage supply establishing a negative bias on the CEM 32. A reverse biased zener/avalanche diode, hereinafter zener diode 40 is coupled to the output 38, as shown. In the illustration, a collector 42 is in spaced relation with the output of the CEM 32. The anode end 44 of the zener diode 40 is electrically connected to the output 38 of the electron multiplier 32 and the cathode end 46 of the zener diode 40 is electrically connected to the system reference potential, indicated by the ground symbol. The zener diode 40 is reverse biased relative to the supply 34. In this configuration, the zener diode 40 provides a small potential (e.g., 20 V–80 V) from the output end 38 of the electron multiplier 32 to the collector 42. This potential is negative and is used to accelerate the electrons exiting the electron multiplier 32 to the collector 42. In the known design of FIG. 1, the bias resistor 28 is used in place of the zener diode 40 and provides the accelerating potential by voltage division between the dynode resistance and bias resistance as previously described. In the present invention, the zener diode is substituted and the following relationship is established between the input and the output:

$$V_o = V_i R_z / R_z + R_d$$

$R_z$ is the resistance of the bias leg, i.e., or zener diode 40 and $R_d$ is the resistance of the CEM. $V_o$ is the output voltage, and $V_i$ is the input voltage.

There are two major advantages to using the reverse biased zener diode 40 instead of the bias resistor. The first is that any increase in $V_i$ will be applied entirely across $R_d$ of the electron multiplier 32. This results in a correspondingly larger increase in gain, which is a function of the potential across the electron multiplier, than would be achieved if the potential was partially divided across the prior art bias resistor. This results in longer life for the detector 30 because the applied voltage will be increased in smaller steps as the gain of the electron multiplier 32 decreases with usage. The second benefit is that the gain of the electron multiplier 32 will be constant from small output currents to its maximum output current in the linear range. A constant gain allows instruments, such as mass spectrometers, to provide accurate quantative results by determining the correct ratio of small signals to large signals regardless of their absolute levels.

In the following exemplary illustration, all currents are depicted as electron currents for simplicity. Kirchhoff's current law must be observed at the output end 38 of the electron multiplier 32. Therefore, the bias current $I_{bo}$ flowing through the zener diode 40 must drop by an amount equal to the output current, $I_o$, of the electron multiplier. Kirchhoff's voltage law must also be observed which means that the sum of the potentials across the bias zener diode 40 and the electron multiplier 32 must be equal to the applied potential $V_i$. In the detector prior art 10 using bias resistor 28, the potential across the bias resistor 28 will decrease in direct proportion to the decrease in the current flowing through it. The potential across the electron multiplier 32 must increase as the output current $I_o$ increases in order to satisfy both Kirchhoff's laws in a detector using a bias resistor. Because the gain is a function of the potential across the electron multiplier, it will also increase with output current $I_o$ and create a non-linear response.

In the detector 30 of the invention, which employs the reverse biased zener diode 40, the potential across the zener diode 40 stays constant with changes in the current flowing through it and results in no change in the potential across the electron multiplier with an increase in output current $I_o$. The potential across the electron multiplier 32 is constant, thus its gain will also be constant with output current, $I_o$. The same effect can be accomplished with the use of a second power supply, with current sinking capability, to provide the potential at the output end of the electron multiplier. However, the use of zener diode 40 biasing requires only one power supply and vacuum feedthrough for the instrument and results in a much lower cost.

Figure 5:
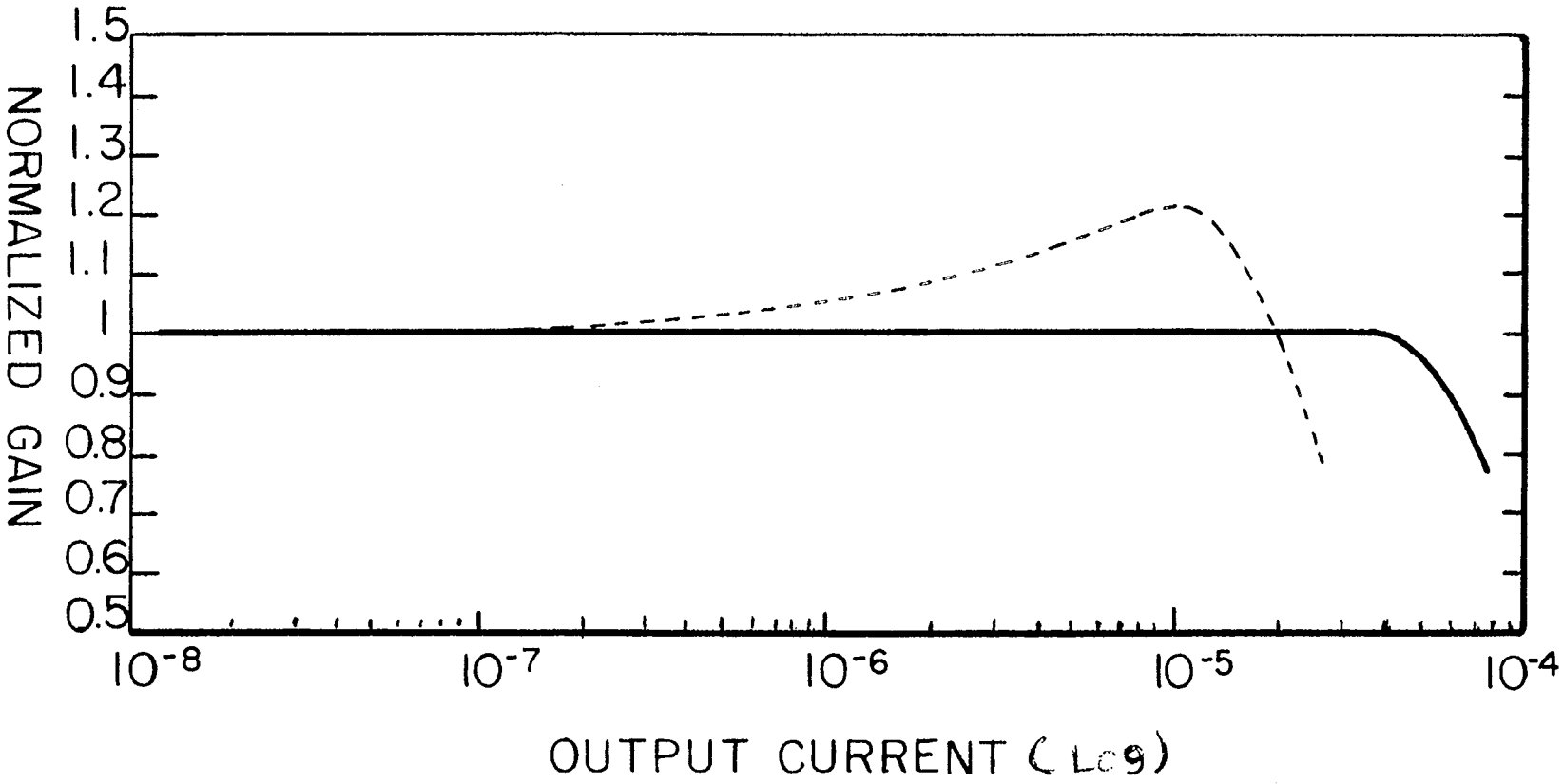
FIG. 5 is a graphical representation comparing gain versus output current of a conventional detector and a detector according to the invention.

FIG. 5 is a graphical representation which compares the gain versus output current, plotted logarithmically, of a conventional detector with a CEM according to the teachings of the present invention. In FIG. 5, the dotted line represents the conventional detector. Note how the gain increases with output current above about $10^{-7}$a. The solid line curve, representative of the present invention, is flat and linear up to $4\times10^{-5}$a. The dynamic range is also improved.

Figure 6:
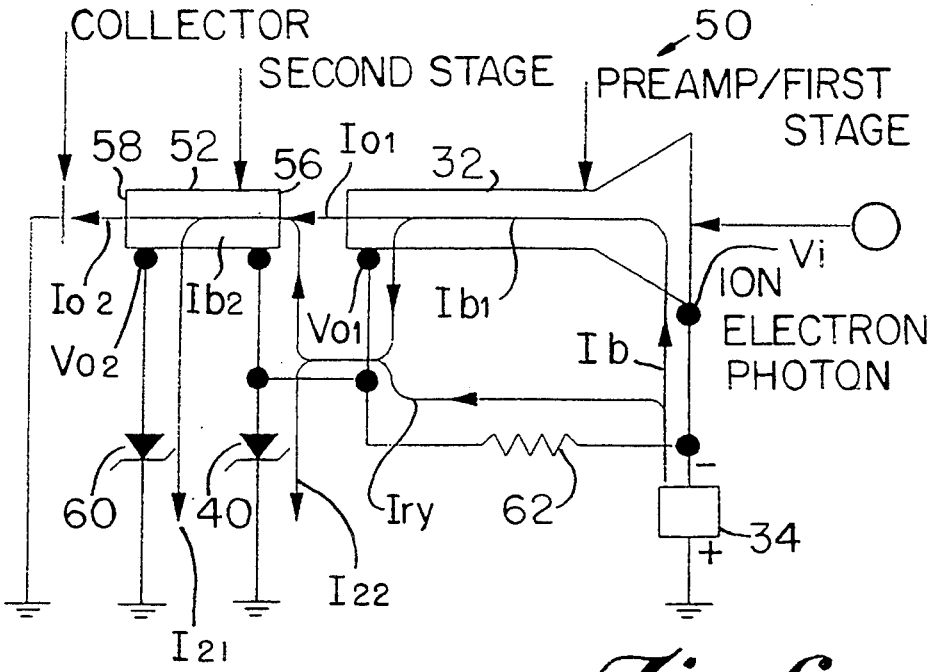
FIG. 6 is a schematic illustration of a multistage channel electron multiplier according to the present invention with circuit elements and electron currents illustrated.

FIG. 6 shows an extension of this biasing technique for a two stage detector 50. This detector employs a second channel electron multiplier 52 having an input end 56 and an output end 58. The second CEM has a low electrical resistance relative to the first CEM 32. A second zener diode 60, and a bypass resistor 62 are also employed. In this arrangement, it is desired to have a low resistance second stage 52 with a greater bias current $I_{b2}$ than the first stage bias cutter $I_{b1}$. This allows the second stage to supply greater linear output current. The bypass resistor 62 is used to supply the extra current $I_{ry}$ to the node 60 where the first and second stage are electrically connected. Without the zener diodes 40 and 60 or two extra power supplies, the system would employ a simple voltage divider as described for the one stage detector. The reversed biased zener diodes 40 and 60 fix the potentials at the node 60 where the first and second stage meet as well as the output 58 of the second stage 52. The two stage arrangement allows a larger maximum output current $I_{o2}$, while keeping the power dissipation in the electron multiplier low so as to avoid thermal runaway and drift in the gain, which are a function of operating temperature.

Power dissipation is defined as the product of the potential and the current. The first stage 32 has a high potential across it, $V_i$–$V_{oi}$, but a relatively low bias current $I_{b1}$. The first stage, therefore, has a high gain but low power dissipation and maximum output current capability. The second stage has a low potential across it, $V_{o1}$–$V_{o2}$, but has a high bias current $I_{b2}$ to achieve a larger maximum output current while dissipating little power. The second stage potential and geometry are chosen to achieve a gain for the second stage that is equal to the ratio of the maximum output currents of the second and first stages. This allows both stages to saturate simultaneously for maximum efficiency. The resistance $R_y$ of bypass resistor 62 can be determined by the following equation:

$$R_y = \frac{V_i^{min} - V_{o1}}{I_{b2} - I_{b1} + I_{z2}^{min} + I_{o1}^{max}}$$

$V_i^{min}$ is the minimum potential at which the electron multiplier will be operated. $I_{z2}^{min}$ is the minimum current at which $Z_2$ will operate. $I_{o1}^{max}$ is the maximum output current of the first stage.

The ground reference can be at any potential relative to OV to result in a negative, 0, or positive potential on the input of the electron multiplier for detection of positive ions, negative ions, photons, or neutral particles. The two stage arrangement can also be extended to more stages by adding an additional zener diode for each stage and a bypass resistor between stages using the framework provided for the two stage detector. The first or preamplifying and additional stage or stages of electron multipliers can include any combination of single channel continuous dynode electron multipliers, multichannelplate continuous dynode electron multipliers, discrete dynode electron multipliers, or solid state electron detectors such as pin diodes.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed is:

1. An electron multiplier having an input and an output for connection to a high voltage supply at a level to produce a desired gain comprising:

a continuous saturable dynode for producing an output current which varies linearally in a region below saturation;

a bias circuit coupled between the input and the output for establishing a fixed output voltage and a substantially constant gain characteristic in said linear region, including at least one zener diode being reverse biased relative to the supply.

2. The electron multiplier of claim 1 wherein the zener diode has a resistance which varies with changes in output current so that the gain of the electron multiplier remains substantially constant.

3. The electron multiplier of claim 1 wherein the dynode is degradable over time and the high voltage supply is selectable to compensate for degradation of the dynode.

4. The electron multiplier of claim 1 wherein the high voltage supply is more negative at the input relative to the output of the dynode.

5. The electron multiplier of claim 1 further comprising a plurality of serially connected electron multiplier stages.

6. The electron multiplier of claim 1 further including at least one bypass resistor in the bias circuit coupled between the input and the output.

7. The electron multiplier of claim 1 wherein the electron multiplier comprises at least one of a channel electron multiplier and a multichannel plate.

8. The electron multiplier of claim 1 wherein the gain is linear up to about $1.4\times10^{-5}$a.

9. The electron multiplier of claim 1 wherein the gain is linear above $1\times10^{-7}$a.

10. The electron multiplier of claim 3 wherein the high voltage supply necessary to compensate for degradation of the dynode is below the level necessary to compensate for a conventional dynode without a zener diode.

11. An electron detector having an input and an output for connection to a high voltage supply at a level sufficient to produce a desired gain comprising:

an electron multiplier including a continuous dynode, said electron multiplier having a substantially continuous gain for producing an output current which varies linearally in a region below saturation;

a bias circuit coupled between the input and the output of the electron multiplier for establishing a fixed output voltage and a substantially constant gain characteristic in said linear region, said bias circuit including at least one zener diode for the dynode, said zener diode being reversed biased relative to the high voltage supply.

12. A multistage electron multiplier having an input and an output for connection to a high voltage supply at a level to produce a desired gain, each stage comprising:

a continuous saturable dynode for producing an output current which varies linearly in a region below saturation;

and a bias circuit coupled between the input and the output for establishing a fixed output voltage and a substantially constant gain characteristic in said linear region, including at least one zener diode being reversed biased relative to the supply.

* * * * *